United States Patent [19]

Matla et al.

[11] 4,278,357

[45] Jul. 14, 1981

[54] APPARATUS FOR CONTROLLING IMPRESSION IN A DAISY WHEEL PRINTER

[75] Inventors: Arno Matla; Horst D. Matthaei, both of Waldenbuch, Fed. Rep. of Germany

[73] Assignee: International Business Machines Corporation, Armonk, N.Y.

[21] Appl. No.: 48,920

[22] Filed: Jun. 15, 1979

[30] Foreign Application Priority Data

Jul. 22, 1978 [DE] Fed. Rep. of Germany ..... 2832338

[51] Int. Cl.[3] ..... B41J 1/26; B41J 1/60

[52] U.S. Cl. ..... 400/144.2; 101/93.03; 400/157.3; 400/166

[58] Field of Search ..... 101/93.03; 400/144.2, 400/157.3, 166

[56] References Cited

U.S. PATENT DOCUMENTS

| | | | |
|---|---|---|---|
| 3,970,186 | 7/1976 | Sohl et al. | 400/174 |
| 4,119,384 | 10/1978 | Keither | 400/166 |

FOREIGN PATENT DOCUMENTS

| | | | |
|---|---|---|---|
| 2545373 | 1/1977 | Fed. Rep. of Germany | 400/161.1 |
| 2746293 | 4/1978 | Fed. Rep. of Germany | 400/144.2 |
| 2614801 | 12/1978 | Fed. Rep. of Germany | 400/166 |
| 1190506 | 5/1970 | United Kingdom | 400/145 |

OTHER PUBLICATIONS

Sherba, "Uniform Pressure Printer", IBM Technical Disclosure Bulletin, vol. 4, No. 6. p. 9, 11/61.

Scott, "Uniform Pressure Printer", IBM Technical Disclosure Bulletin, vol. 4. No. 6, p. 10, 11/61.

Mathews, "Print Hammer Mechanism", IBM Technical Disclosure Bulletin, vol. 19, No. 9, pp. 3245–3246, 2/77.

Molloy, "Inhibiting Embossing on Impact Printers", IBM Technical Disclosure Bulletin, vol. 20, No. 10, pp. 3998–3999, 3/78.

*Primary Examiner*—William Pieprz

*Attorney, Agent, or Firm*—James H. Barksdale, Jr.

[57] ABSTRACT

A daisy wheel spring disc utilized in conjunction with a daisy wheel print element to control impression. Both the spring disc and the print element have radially extending petals. The print element petals carry a character adjacent their outer extremity. A spring disc petal is associated with each print element petal for which impression is to be controlled. The spring disc petals vary in length relative to the print element petals. The lengths of the spring disc petals depend upon whether the character on the associated print wheel petal has a large or small print surface area. During printing, the spring disc is positioned on the printing side of the print element. When a print element petal is driven out of the plane of the remaining print element petals during printing of a character, the associated spring disc petal will be contacted and will absorb a portion of the energy imparted to the print element petal.

9 Claims, 2 Drawing Figures

APPARATUS FOR CONTROLLING IMPRESSION IN A DAISY WHEEL PRINTER

BACKGROUND OF THE INVENTION

1. Field of the Invention

This invention relates to apparatus for controlling impact forces or impression based on the sizes of the characters to be printed with a daisy wheel printer.

2. Description of the Prior Art

Representative known art in the impression control area are IBM Technical Disclosure Bulletin (TDB) Vol. 19, No. 8, January 1977, pages 3107 and 3108, and Vol. 19, No. 2, July 1976, pages 443 and 444.

In the first mentioned IBM TDB, impression, and thus print quality, are controlled in an on-the-fly daisy wheel printer by controlling the turn on time and on time of a print hammer.

In the second mentioned IBM TDB, a resilient pad and type element thicknesses matched to character areas are utilized for controlling impression.

From the above, a number of structural arrangements are available for controlling impression or character impact energy during printing.

SUMMARY OF THE INVENTION

Apparatus is provided for utilization in a daisy wheel printer for controlling impression and obtaining a desired level of print quality. More specifically, a daisy wheel print element and a spring disc are used in conjunction with one another to control character impact forces during printing. The print element is made up of a central hub having a number of petals extending radially from its periphery. Each radially extending petal carries a character adjacent its outer extremity. The spring disc is also made up of a central hub and has a number of radially extending petals. There can be a spring petal for each character petal having a character for which impression is to be controlled. The lengths of the spring petals vary with the size of the characters. The size of the characters can be defined in terms of overall surface area or width along a writing line. During printing, the spring disc is located on the printing side of the print element. That is, the print element is interposed between a print hammer included in the printer and the spring disc. Further, the spring disc is positioned such that when a print element petal is driven out of the plane of the remaining print element petals, the associated spring disc petal will be contacted and/or will restrain movement of the print element petal. Thus, the spring disc serves to absorb a portion of the energy imparted to the print element petals by the print hammer. Such an arrangement serves to ensure that each of the different characters on the print element is uniformly printed. In the absence of structure for absorbing a portion of the energy imparted by a single force hammer structured to uniformly print large surface area characters, it is likely that the paper would be perforated during printing of small surface area characters. For example, if a period and the character & were caused to impact the paper with the same force and this force were proper for the &, the period would most likely perforate the paper. Therefore, the impact energy for printing a period must be less than that used for printing the character &.

It is therefore an object of the present invention to provide apparatus for controlling the impact energies in daisy wheel printers according to the sizes of the characters to be printed. Another object of the present invention is to provide apparatus which is simple and inexpensive.

DESCRIPTION OF THE PREFERRED EMBODIMENT

Figure 1:
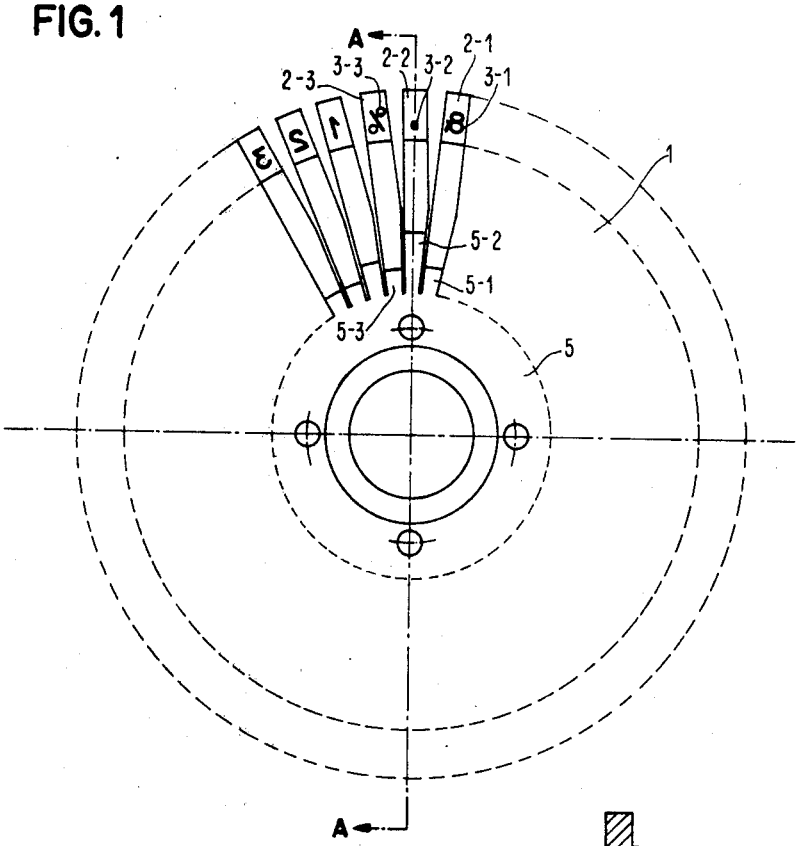
FIG. 1 is a plan view of a daisy wheel print element and cooperating spring disc.

Daisy wheel print elements such as that designated by reference numeral 1 in FIG. 1 are made up of a central hub and radially extending character petals. Many such print elements are readily available in the marketplace and are comprised of a variety of materials. Regardless of composition of known print elements, the character petals act as leaf springs and abosrb along their length a portion of the kinetic energy imparted thereto by a print hammer. The proportion of energy withdrawn or absorbed by the print element petals during a printing process can be increased by increasing the petal spring rate. When quality printing is desired and a single force hammer matched to the largest surface area characters is used, the spring rate must be increased as the surface areas of the characters on print element 1 decrease. According to this invention, a spring disc 5 is utilized to control the spring rate of various of the character petals. Disc 5 has a central hub and radially extending petals such as 5-1, 5-2, and 5-3. Disc 5 is arranged in front of the print element 1 in the direction of a sheet of paper or other record medium (not shown).

Figure 2:
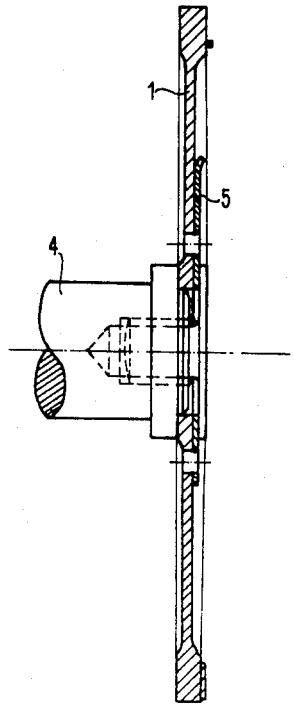
FIG. 2 is a cross-sectional view of the print element and disc shown in FIG. 1, taken along line A—A.

For a more complete understanding of the invention, reference is made to both FIGS. 1 and 2. Print element 1 consists of one molded piece composed of a suitable resilient material. Print element 1 has a plurality of radially extending petals 2-1, 2-2, 2-3, etc., carrying characters 3-1, 3-2, 3-3, etc., on the outer extremities thereof.

Element 1 is adapted for utilization in a so-called front page printer. In a printer of this type, a print hammer located behind a petal such as 2-2 causes petal 2-2 to be translated out of the plane of the remaining petals and toward the record medium for effecting printing of character 3-2.

For printing various of characters 3-1, 3-2, 3-3, etc., on the record medium, print element 1 which is carried by rotatable shaft 4, is rotated either intermittently or continuously.

Also carried by shaft 4 is spring disc 5, which is preferably made of spring steel. Spring disc 5 is similar to print element 1 in that it is provided with individual radially extending petals such as 5-1, 5-2, 5-3, etc. The pitch, or angle of radial projection of the petals of spring disc 5 corresponds to the pitch of the petals on the print element 1.

Spring disc 5 is mounted adjacent print element 1 in such a manner that the petals of print element 1 are aligned with the petals of spring disc 5. Element 1 and disc 5 can be secured together by means of rivets or in any other conventional manner. They may also be screwed to shaft 4.

The length of each petal on disc 5 will correspond to the size of each associated character on element 1 in terms of surface area or writing line width. During printing, the petals of element 1 are impacted by the print hammer and driven toward the record medium for impact therewith. The spring petals of disc 5 absorb a portion of the energy thus imparted to the characters to control the impact energy. For example, spring petal 5-2 is longer than adjacent petals associated with other characters and the impact energy of the period 3-2 on petal 2-2 is thusly reduced. The longer spring petal 5-2 compensates for the small character surface area of the period.

In contrast, the & character 3-1 has a much greater surface area and width and requires a greater impact energy than the period 3-2 for uniform printing. Therefore, the length of spring petal 5-1 is shorter than petal 5-2. As such, less energy will be absorbed by petal 5-1. From the above, the lengths of the spring petals are inversely proportional to the sizes of the associated characters.

In the above, it has been assumed that the print hammer, independent of the character to be printed, is energized at the same level for all characters.

In summary, the length of each spring petal is matched to the surface area or writing line width of the character to be printed. If the character writing line width is narrow or the character print area is small, the spring petal must be long in order to absorb the excess energy imparted by the print hammer. On the other hand, if the character line width or surface area is large, the spring petal must be short in order not to withdraw too much energy.

The use of a spring disc in conjunction with a daisy wheel print element as above described is particularly advantageous from the following standpoints.

(a) When a daisy wheel printer is used in a text processing system, an attractive and optimum print image is obtained. The print quality is enhanced by the fact that the print element characters are adapted to the print hammer energy.

(b) The changing of print elements and spring discs is readily facilitated. When the elements and discs are separate, they are mountable on the same shaft. When bonded together to form one unit, the unit is readily installable on the shaft.

(c) Due to the lack of complexity, the use of a spring disc for controlling impression presents a simple and inexpensive solution to quality printing problems.

The character sequence or order of adjacent characters has been arbitrarily chosen and serves to explain the principles of this invention. Other embodiments of the invention are conceivable. For example, when print elements made up of individual metal petals are contemplated, the spring disc could be cast in included grooves. Where the print element and spring disc are to comprise a single unit, the spring disc may be glued or soldered to the print element.

What is claimed is:

1. An apparatus for controlling impression in a daisy wheel printer for printing characters of different sizes, said daisy wheel printer including a print element having radially extending petals with said characters on the outer extermities thereof, said apparatus comprising radially extending spring petals associated with said element petals for which impression is to be controlled, the lengths of said spring petals being inversely proportional to the sizes of said characters.

2. An apparatus according to claim 1 wherein said radially extending petals comprise part of a spring disc.

3. An apparatus according to claim 2 including a daisy wheel print element having radially extending petals with said characters on the outer extremities thereof.

4. An apparatus according to claim 3 wherein said disc is located adjacent said element and on the printing side thereof.

5. An apparatus according to claim 4 wherein the pitch of said disc petals corresponds to the pitch of said element petals.

6. An apparatus according to claim 5 wherein said disc and said element are interposed between a print hammer included in said printer and a record medium during printing of said characters.

7. An apparatus according to claim 6 wherein said spring disc is located adjacent said print element such that said disc petals absorb a portion of the energy imparted to said element petals by said print hammer during printing.

8. An apparatus for controlling print impression in a daisy wheel printer, said apparatus comprising in combination:

(a) a daisy wheel print element having radially extending petals with characters adjacent the outer extremities thereof; and (b) a spring member adjacent said print element and including a number of radially extending petals pitched to correspond to the pitch of a number of said petals on said print element, each said spring member petal being of a length which is inversely proportional to the size of a character on a corresponding print element petal.

9. An apparatus according to claim 8 wherein said spring member is located on the printing side of said print element.

* * * * *